US005413698A

United States Patent [19]

Fletcher et al.

[11] Patent Number: 5,413,698

[45] Date of Patent: May 9, 1995

[54] HYDROCARBON UPGRADING PROCESS

[75] Inventors: David L. Fletcher, Turnersville, N.J.; Mohsen N. Harandi, Langhorne, Pa.; Michael S. Sarli, Haddonfield; Stuart S. Shih, Cherry Hill, both of N.J.

[73] Assignee: Mobil Oil Corporation, Fairfax, Va.

[21] Appl. No.: 925,001

[22] Filed: Aug. 5, 1992

Related U.S. Application Data

[63] Continuation-in-part of Ser. No. 850,106, Mar. 12, 1992, which is a continuation-in-part of Ser. No. 745,311, Aug. 15, 1991.

[51] Int. Cl.[6] ..... C10G 69/02

[52] U.S. Cl. ..... 208/89; 208/212; 208/211; 208/213; 208/58

[58] Field of Search ..... 208/89, 211–213, 208/58

[56] References Cited

U.S. PATENT DOCUMENTS

| | | | |
|---|---|---|---|
| 3,759,821 | 9/1973 | Brennan et al. | 208/93 |
| 3,767,568 | 10/1973 | Chen | 208/134 |
| 3,923,641 | 12/1975 | Morrison | 208/111 |
| 3,957,625 | 5/1976 | Orkin | 208/212 |
| 4,049,542 | 9/1977 | Gibson et al. | 208/213 |
| 4,062,762 | 12/1977 | Howard et al. | 208/211 |
| 4,309,280 | 1/1982 | Rosinski et al. | 208/120 |
| 4,368,114 | 1/1983 | Chester et al. | 208/120 |
| 4,738,766 | 4/1988 | Fischer et al. | 208/68 |
| 4,753,720 | 6/1988 | Morrison | 208/135 |
| 4,827,076 | 5/1989 | Kokayeff et al. | 208/213 |
| 4,827,676 | 5/1989 | Kokayeff | 208/212 |
| 5,143,596 | 9/1992 | Maxwell et al. | 208/89 |

*Primary Examiner*—Helane Myers

*Attorney, Agent, or Firm*—Alexander J. McKillop; Malcolm D. Keen; Jessica M. Sinnott

[57] ABSTRACT

Low sulfur gasoline of relatively high octane number is produced from a catalytically cracked, sulfur-containing naphtha by hydrodesulfurization followed by treatment in a second step over a a first catalyst zone comprising a large pore size zeolite material and a second catalyst zone comprising an intermediate pore size material. Preferably, the large pore size material is zeolite beta and the intermediate pore size material is ZSM-5. The treatment in the second step restores the octane loss which takes place as a result of the hydrogenative treatment and results in a low sulfur gasoline product with an octane number comparable to that of the feed naphtha. In favorable cases, using feeds of extended end point such as heavy naphthas with 95 percent points above about 380° F. (about 193° C.), improvements in both product octane and yield relative to the feed may be obtained.

23 Claims, No Drawings

HYDROCARBON UPGRADING PROCESS

CROSS REFERENCE TO RELATED APPLICATIONS

This application is a continuation-in-part of our prior application Ser. No. 07/850,106, filed on Mar. 12, 1992, pending, which is a continuation-in-part of Ser. No. 07/745,311, filed on Aug. 15, 1991, pending, which are both incorporated herein by reference in their entireties.

FIELD OF THE INVENTION

This invention relates to a process for the upgrading of hydrocarbon streams. It more particularly refers to a process for upgrading gasoline boiling range petroleum fractions containing substantial proportions of sulfur impurities. The process involves integration of a first step hydrotreating of a sulfur-containing cracked petroleum fraction in the gasoline boiling range and a second step conversion of the hydrotreated intermediate product over a first catalyst zone and a second catalyst zone. The first catalyst zone comprises a large pore zeolite material having the topology of zeolite beta and the second catalyst zone comprises an intermediate pore zeolite material having the topology of ZSM-5.

BACKGROUND OF THE INVENTION

Catalytically cracked gasoline forms a major part of the gasoline product pool in the United States. It is conventional to recover the product of catalytic cracking and to fractionate the product into various fractions such as light gases; naphtha, including light and heavy gasoline; distillate fractions, such as heating oil and Diesel fuel; lube oil base fractions; and heavier fractions.

A large proportion of the sulfur in gasoline results from the catalytically cracked gasoline component due to the sulfur content of the petroleum fractions being catalytically cracked. The sulfur impurities may require removal, usually by hydrotreating, in order to comply with product specifications or to ensure compliance with environmental regulations both of which are expected to become more stringent in the future, possibly permitting no more than about 300 ppmw sulfur in motor gasolines. Low sulfur levels result in reduced emissions of CO, $NO_x$ and hydrocarbons.

In naphtha hydrotreating, the naphtha is contacted with a suitable hydrotreating catalyst at elevated temperature and somewhat elevated pressure in the presence of a hydrogen atmosphere. One suitable family of catalysts which has been widely used for this service is a combination of a Group VIII and a Group VI element, such as cobalt and molybdenum, on a suitable substrate, such as alumina. After completion of hydrotreating, the product may be fractionated, or flashed, to release the hydrogen sulfide and collect the sweetened gasoline.

However, cracked naphtha, as it comes from the catalytic cracker and without any further treatments, such as purifying operations, has a relatively high octane number as a result of the presence of olefinic components. It also has an excellent volumetric yield. As such, cracked gasoline is an excellent contributor to the gasoline pool. It contributes a large quantity of product at a high blending octane number. In some cases, this fraction may contribute as much as up to half the gasoline in the refinery pool.

Hydrotreating of any of the sulfur containing fractions which boil in the gasoline boiling range causes a reduction in the olefin content, and consequently a reduction in the octane number and as the degree of desulfurization increases, the octane number of the normally liquid gasoline boiling range product decreases. Some of the hydrogen may also cause some hydrocracking as well as olefin saturation, depending on the conditions of the hydrotreating operation.

Proposals have been made for removing sulfur impurities while retaining the high octane contributed by the olefins. Since the sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. Alternatively, the selectivity for hydrodesulfurization relative to olefin saturation may be shifted by suitable catalyst selection, for example, by the use of a magnesium oxide support instead of the more conventional alumina. U.S. Pat. No. 4,049,542 (Gibson), for instance, discloses a process in which a copper catalyst is used to desulfurize an olefinic hydrocarbon feed such as catalytically cracked light naphtha.

In any case, regardless of the mechanism by which it happens, the decrease in octane which takes place as a consequence of sulfur removal by hydrotreating creates a tension between the growing need to produce gasoline fuels with higher octane number and—because of current ecological considerations—the need to produce cleaner burning, less polluting fuels, especially low sulfur fuels. This inherent tension is yet more marked in the current supply situation for low sulfur, sweet crudes.

Other processes for enhancing the octane rating of catalytically cracked gasolines have also been proposed in the past. For example, U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

Other methods have been proposed for increasing the octane number of the gasoline pool. Naphthas, including light and full range naphthas, may be subjected to catalytic reforming so as to increase their octane numbers by converting at least a portion of the paraffins and cycloparaffins in them to aromatics. Fractions to be fed to catalytic reforming, such as over a platinum type catalyst, also need to be desulfurized before reforming because reforming catalysts are generally not sulfur tolerant. Thus, naphthas are usually pretreated by hydrotreating to reduce their sulfur content before reforming. The octane rating of reformate may be increased further by processes such as those described in U.S. Pat. No. 3,767,568 and U.S. Pat. No. 3,729,409 (Chen) in which the reformate octane is increased by treatment of the reformate with ZSM-5.

Aromatics are generally the source of high octane number, particularly very high research octane numbers and are therefore desirable components of the gasoline pool. They have, however, been the subject of severe limitations as a gasoline component because of possible adverse effects on the ecology, particularly with reference to benzene. It has therefore become desirable, as far as is feasible, to create a gasoline pool in which the higher octanes are contributed by the olefinic and branched chain paraffinic components, rather than the aromatic components. Light and full range naphthas can contribute a substantial volume to the gasoline pool, but they do not generally contribute significantly to higher octane values without reforming.

We have demonstrated in our prior co-pending applications Ser. No. 07/850,106, filed on Mar. 12, 1992 and Ser. No. 07/745,311, filed on Aug. 15, 1991 that zeolite ZSM-5 is effective for restoring the octane loss which takes place when the initial naphtha feed is hydrotreated. When the hydrotreated naphtha is passed over the catalyst in the second step of the process, some components of the gasoline are cracked into lower boiling range materials. If these boil below the gasoline boiling range, there will be a loss in the yield of the gasoline product. However, if the cracked products are within the gasoline boiling range, an increase occurs in the net volumetric yield. To achieve this, it is helpful to increase the end point of the naphtha feed to the extent that this will not result in exceeding the gasoline product end point, or similar restrictions (e.g. $T_{90}$, $T_{95}$).

SUMMARY OF THE INVENTION

We have now developed an improvement in the octane restoration step which will isomerize paraffins and improve back end conversion while cracking the normal paraffins of the hydrotreating step to result in an enhanced octane boost as well as an increased overall gasoline yield.

Thus, the process catalytically desulfurizes cracked fractions in the gasoline boiling range which enables the sulfur to be reduced to acceptable levels without substantially reducing the octane number. In favorable cases, the volumetric yield of gasoline boiling range product is not substantially reduced and may even be increased if potential alkylate from $C_3$ and $C_4$ olefins are included so that the number of octane barrels of product produced is at least equivalent to the number of octane barrels of feed introduced into the operation.

The process may be utilized to desulfurize light and full range naphtha fractions while maintaining octane so as to obviate the need for reforming such fractions, or at least, without the necessity of reforming such fractions to the degree previously considered necessary. Since reforming generally implies a significant yield loss, this constitutes a marked advantage.

The invention is based upon an improvement in the octane restoration step in which a large pore material having isomerization capability is located in a first catalyst zone and an intermediate pore material having cracking capability is located in a second catalyst zone.

According to the present invention, a sulfur-containing cracked petroleum fraction in the gasoline boiling range is hydrotreated, in a first step, under conditions which remove at least a substantial proportion of the sulfur. The hydrotreated intermediate product is then treated, in a second step, by contacting a first catalytic zone comprising a large pore material such as a zeolite having the topology of zeolite beta and a second catalytic zone which comprises an intermediate pore material such as a zeolite having the topology of ZSM-5 under conditions which convert the hydrotreated intermediate product fraction to a fraction in the gasoline boiling range of higher octane value.

Thus, the invention is directed to a process for upgrading a sulfur-containing feed fraction boiling in the gasoline boiling range which comprises:

contacting the sulfur-containing feed fraction with a hydrodesulfurization catalyst in a first reaction step, operating under a combination of elevated temperature, elevated pressure and an atmosphere comprising hydrogen, to produce an intermediate product comprising a normally liquid fraction which has a reduced sulfur content and a reduced octane number as compared to the feed; and contacting at least the gasoline boiling range portion of the intermediate product in a second reaction step over a first catalyst zone comprising a large pore size zeolite material and a second catalyst zone comprising an intermediate pore size zeolite material to convert it to a product comprising a fraction boiling in the gasoline boiling range having a higher octane number than the gasoline boiling range fraction of the intermediate product.

For purposes of this invention, the term "hydrotreating" is used as a general process term descriptive the reactions of the first reaction zone in which a prevailing degree of hydrodesulfurization occurs.

DETAILED DESCRIPTION

Feed

The feed to the process comprises a sulfur-containing petroleum fraction which boils in the gasoline boiling range. Feeds of this type include light naphthas typically having a boiling range of about $C_6$ to 330° F., full range naphthas typically having a boiling range of about $C_5$ to 420° F., heavier naphtha fractions boiling in the range of about 260° F. to 412° F., or heavy gasoline fractions boiling at, or at least within, the range of about 330° to 500° F., preferably about 330° to 412° F. While the most preferred feed appears at this time to be a heavy gasoline produced by catalytic cracking; or a light or full range gasoline boiling range fraction, the best results are obtained when, as described below, the process is operated with a gasoline boiling range fraction which has a 95 percent point (determined according to ASTM D 86) of at least about 325° F. (163° C.) and preferably at least about 350° F. (177° C.), for example, 95 percent points of at least 380° F. (about 193° C.) or at least about 400° F. (about 220° C.).

The process may be operated with the entire gasoline fraction obtained from the catalytic cracking step or, alternatively, with part of it. Because the sulfur tends to be concentrated in the higher boiling fractions, it is preferable, particularly when unit capacity is limited, to separate the higher boiling fractions and process them through the steps of the present process without processing the lower boiling cut. The cut point between the treated and untreated fractions may vary according to the sulfur compounds present but usually, a cut point in the range of from about 100° F. (38° C.) to about 300° F. (150° C.), more usually in the range of about 200° F. (93° C.) to about 300° F. (150° C.) will be suitable. The exact cut point selected will depend on the sulfur specification for the gasoline product as well as on the type of sulfur compounds present: lower cut points will typically be necessary for lower product sulfur specifications. Sulfur which is present in components boiling below about 150° F. (65° C.) is mostly in the form of mercaptans which may be removed by extractive type processes such as Merox but hydrotreating is appropriate for the removal of thiophene and other cyclic sulfur compounds present in higher boiling components e.g. component fractions boiling above about 180° F. (82° C.). Treatment of the lower boiling fraction in an extractive type process coupled with hydrotreating of the higher boiling component may therefore represent a preferred economic process option. Higher cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw and in most cases in excess of about 500 ppmw. For the fractions which have 95 percent points over about 380° F. (193° C.), the sulfur content may exceed about 1,000 ppmw and may be as high as 4,000 or 5,000 ppmw or even higher, as shown below. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F. (193° C.). The nitrogen level will, however, usually not be greater than 250 or 300 ppmw. As a result of the cracking which has preceded the steps of the present process, the feed to the hydrodesulfurization step will be olefinic, with an olefin content of at least 5 and more typically in the range of 10 to 20, e.g. 15–20, weight percent.

The following Table 1 exemplifies the composition of a naphtha feed of the kind which can be processed in accordance with this invention.

TABLE 1

| Heavy FCC Naphtha | |
|---|---|
| Gravity, °API | 23.5 |
| Hydrogen, wt % | 10.23 |
| Sulfur, wt % | 2.0 |
| Nitrogen, ppmw | 190 |
| Clear Research Octane, R+O | 95.6 |
| Composition, wt % | |
| Paraffins | 12.9 |
| Cyclo Paraffins | 8.1 |
| Olefins and Diolefins | 5.8 |
| Aromatics | 73.2 |
| Distillation, ASTM D-2887, | °F./°C. |
| 5% | 289/143 |
| 10% | 355/179 |
| 30% | 405/207 |
| 50% | 435/224 |
| 70% | 455/235 |
| 90% | 482/250 |
| 95% | 488/253 |

Process Configuration

The selected sulfur-containing, gasoline boiling range feed is treated in two steps by first hydrotreating the feed by effective contact of the feed with a hydrotreating catalyst, which is suitably a conventional hydrotreating catalyst, such as a combination of a Group VI and a Group VIII metal on a suitable refractory support such as alumina, under hydrotreating conditions. Under these conditions, at least some of the sulfur is separated from the feed molecules and converted to hydrogen sulfide, to produce a hydrotreated intermediate product comprising a normally liquid fraction boiling in substantially the same boiling range as the feed (gasoline boiling range), but which has a lower sulfur content and a lower octane number than the feed.

This hydrotreated intermediate product which also boils in the gasoline boiling range (and usually has a boiling range which is not substantially higher than the boiling range of the feed), is then treated under conditions which produce a second product comprising a fraction which boils in the gasoline boiling range which has a higher octane number than the portion of the hydrotreated intermediate product fed to this second step. The product from this second step usually has a boiling range which is not substantially higher than the boiling range of the feed to the hydrotreater, but it is of lower sulfur content while having a comparable octane rating as the result of the second step treatment.

Hydrotreating

The temperature of the hydrotreating step is suitably from about 400° to 850° F. (about 220° to 454° C.), preferably about 500° to 800 ° F. (about 260° to 427° C.) with the exact selection dependent on the desulfurization desired for a given feed and catalyst. Because the hydrogenation reactions which take place in this step are exothermic, a rise in temperature takes place along the reactor; this is actually favorable to the overall process when it is operated in the cascade mode because the second step is one which implicates cracking, an endothermic reaction. In this case, therefore, the conditions in the first step should be adjusted not only to obtain the desired degree of desulfurization but also to produce the required inlet temperature for the second step of the process so as to promote the desired shape-selective cracking reactions in this step. A temperature rise of about 20° to 200° F. (about 11° to 111° C.) is typical under most hydrotreating conditions and with reactor inlet temperatures in the preferred 500° to 800° F. (260° to 427° C.) range, will normally provide a requisite initial temperature for cascading to the second step of the reaction. When operated in the two-stage configuration with interstage separation and heating, control of the first stage exotherm is obviously not as critical; two-stage operation may be preferred since it offers the capability of decoupling and optimizing the temperature requirements of the individual stages.

Since the feeds are readily desulfurized, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity (hydrodesulfurization step) is typically about 0.5 to 10 LHSV ($hr^{-1}$), preferably about 1 to 6 LHSV ($hr^{-1}$). The hydrogen to hydrocarbon ratio in the feed is typically about 500 to 5000 SCF/Bbl (about 90 to 900 $n.l.l^{-1}$.), usually about 1000 to 2500 SCF/B (about 180 to 445 $n.l.l^{-1}$.). The extent of the desulfurization will depend on the feed sulfur content and, of course, on the product sulfur specification with the reaction parameters selected accordingly. It is not necessary to go to very low nitrogen levels but low nitrogen levels may improve the activity of the catalyst in the second step of the process. Normally, the denitrogenation which accompanies the desulfurization will result in an acceptable organic nitrogen content in the feed to the second step of the process; if it is necessary, however, to increase the denitrogenation in order to obtain a desired level of activity in the second step, the operating conditions in the first step may be adjusted accordingly.

The catalyst used in the hydrodesulfurization step is suitably a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni—Mo or Co—Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used, as convenient.

The particle size and the nature of the hydrotreating catalyst will usually be determined by the type of hydrotreating process which is being carried out, such as: a down-flow, liquid phase, fixed bed process; an upflow, fixed bed, trickle phase process; an ebulating, fluidized bed process; or a transport, fluidized bed process. All of these different process schemes are generally well known in the petroleum arts, and the choice of the particular mode of operation is a matter left to the discretion of the operator, although the fixed bed arrangements are preferred for simplicity of operation.

A change in the volume of gasoline boiling range material typically takes place in the first step. Although some decrease in volume occurs as the result of the conversion to lower boiling products ($C_5-$), the conversion to $C_5-$ products is typically not more than 5 volume percent and usually below 3 volume percent and is normally compensated for by the increased volume swell which takes place as a result of aromatics saturation. An increase in volume is typical for the second step of the process where, as the result of cracking the back end of the hydrotreated feed, cracking products within the gasoline boiling range are produced. An overall increase in volume of the gasoline boiling range ($C_5+$) materials may occur.

Octane Restoration—Second Step Processing

After the hydrotreating step, the hydrotreated intermediate product is passed to the second step of the process in which isomerization and cracking takes place over plurality of catalytic zones.

The effluent from the hydrotreating step may be subjected to an interstage separation in order to remove the inorganic sulfur and nitrogen as hydrogen sulfide and ammonia as well as light ends but this is not necessary and, in fact, it has been found that the effluent of the first step can be cascaded directly into the second step. This can be done very conveniently in a downflow, fixed-bed reactor by loading the hydrotreating catalyst directly on top of the second step catalyst bed.

The separation of the light ends at this point may be desirable if the added complication is acceptable since the saturated $C_4$–$C_6$ fraction from the hydrotreater is a highly suitable feed to be sent to the isomerizer for conversion to iso-paraffinic materials of high octane rating; this will avoid the conversion of this fraction to non-gasoline ($C_5-$) products in the second step of the process. Another process configuration with potential advantages is to take a heart cut, for example, a 195°–302° F. (90°–150° C.) fraction, from the first step product and send it to the reformer where the low octane naphthenes which make up a significant portion of this fraction are converted to high octane aromatics. The heavy portion of the first step effluent is, however, sent to the second step for restoration of lost octane by treatment with the acid catalyst. The hydrotreatment in the first step is effective to desulfurize and denitrogenate the catalytically cracked naphtha which permits the heart cut to be processed in the reformer. Thus, the preferred configuration in this alternative is for the second step to process the $C_8+$ portion of the first step effluent and with feeds which contain significant amounts of heavy components up to about $C_{13}$ e.g. with $C_9$–$C_{13}$ fractions going to the second step, improvements in both octane and yield can be expected.

The conditions used in the second step of the process are those which result in a controlled degree of isomerization, back end conversion at least partially shape-selective cracking of the desulfurized, hydrotreated effluent from the first step to produce olefins which restore the octane rating of the original, cracked feed at least to a partial degree. The reactions which take place during the second step include the shape-selective cracking of low octane paraffins to form higher octane products, both by the selective cracking of heavy paraffins to lighter paraffins and the cracking of low octane n-paraffins, in both cases with the generation of olefins. A substantial degree of isomerization of n-paraffins to branched-chain paraffins of higher octane may take place, making a further contribution to the octane of the final product. Other reactions which take place are less selective and effectuate cracking of bulkier, more highly branched paraffins, olefins and cyclics to lighter products useable as high octane gasoline. In favorable cases, the original octane rating of the feed may be completely restored or perhaps even exceeded. Since the volume of the second step product will typically be comparable to that of the original feed, the number of octane barrels (octane rating$\times$volume) of the final, desulfurized product may exceed the octane barrels of the feed.

The conditions used in the second step are those which are appropriate to produce this controlled degree of cracking. Typically, the temperature of the second step will be about 300° to 900° F. (about 150° to 480° C.), preferably about 350° to 800° F. (about 177° C.). As mentioned above, however, a convenient mode of operation is to cascade the hydrotreated effluent into the second reaction zone and this will imply that the outlet temperature from the first step will set the initial temperature for the second zone. The feed characteristics and the inlet temperature of the hydrotreating zone, coupled with the conditions used in the first step will set the first step exotherm and, therefore, the initial temperature of the second zone. Thus, the process can be operated in a completely integrated manner, as shown below.

The pressure in the second reaction zone is not critical since no hydrogenation is desired at this point in the sequence although a lower pressure in this step will tend to favor olefin production with a consequent favorable effect on product octane. The pressure will therefore depend mostly on operating convenience and will typically be comparable to that used in the first step, particularly if cascade operation is used. Thus, the pressure will typically be about 50 to 1500 psig (about 445 to 10445 kPa), preferably about 300 to 1000 psig (about 2170 to 7000 kPa) with comparable space velocities, typically from about 0.5 to 10 LHSV ($hr^{-1}$), normally about 1 to 6 LHSV ($hr^{-1}$). Hydrogen to hydrocarbon ratios typically of about 0 to 5000 SCF/Bbl (0 to 890 $n.l.l^{-1}$.), preferably about 100 to 2500 SCF/Bbl (about 18 to 445 $n.l.l^{-1}$.) will be selected to minimize catalyst aging.

The use of relatively lower hydrogen pressures thermodynamically favors the increase in volume which occurs in the second step and for this reason, overall lower pressures are preferred if this can be accommodated by the constraints on the aging of the two catalysts. In the cascade mode, the pressure in the second step may be constrained by the requirements of the first but in the two-step mode the possibility of recompression permits the pressure requirements to be individually selected, affording the potential for optimizing conditions in each step.

Consistent with the objective of restoring lost octane while retaining overall product volume, the conversion to products boiling below the gasoline boiling range ($C_5-$) during the second step is held to a minimum. However, because the cracking of the heavier portions of the feed may lead to the production of products still within the gasoline range a net increase in $C_5+$ material may occur during this step of the process, particularly if the feed includes significant amounts of the higher boiling fractions. It is for this reason that the use of the higher boiling naphthas is favored, especially the fractions with 95 percent points above about 350° F. (about 177° C.) and even more preferably above about 380° F. (about 193° C.) or higher, for instance, above about 400° F. (about 205° C.). Normally, however, the 95 percent point will not exceed about 520° F. (about 270° C.) and usually will be not more than about 500° F. (about 260° C.).

Second Step

The second step of the process comprises a first catalyst zone and a second catalyst zone, both being of sufficient acidic functionality to bring about the desired cracking reactions to restore the octane lost in the hydrotreating step.

One measure of the acid activity of a catalyst is its alpha number. This is a measure of the ability of the catalyst to crack normal hexane under prescribed conditions. This test has been widely published and is conventionally used in the petroleum cracking art, and compares the cracking activity of a catalyst under study with the cracking activity, under the same operating and feed conditions, of an amorphous silica-alumina catalyst, which has been arbitrarily designated to have an alpha activity of 1. The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 $sec^{-1}$). The alpha test is described in U.S. Pat. No. 3,354,078 and in *J. Catalysis,* 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in *J. Catalysis,* 61, 395 (1980).

The catalyst used in the second step of the process suitably has an alpha activity of at least about 20, usually in the range of 20 to 800 and preferably at least about 50 to 200. It is inappropriate for this catalyst to have too high an acid activity because it is desirable to only crack and rearrange so much of the intermediate product as is necessary to restore lost octane without severely reducing the volume of the gasoline boiling range product.

The configuration of the catalyst zone is such that the effluent of the hydrodesulfurization step first contacts the large pore size zeolite and then contacts the intermediate pore size zeolite so that the n-paraffins and bulkier components of the effluent which are admitted by the less selective larger pore material are treated first. Thus, the catalyst of the first catalyst zone is comprised of a zeolite component of sufficient pore size to bring about the desired paraffin isomerization and back end conversion reactions. Thereafter, the cracked components are passed over the second catalyst zone which comprises an intermediate pore material for better yield and octane gain. Thus, the second catalyst zone of this second step can be a separate reactor, with or without interstage separation of the light ends, or there can be a catalyst bed comprised of separate catalyst layers such as a fixed-bed reactor in which the catalyst containing the large pore zeolite material is loaded directly on top of the catalyst containing the intermediate pore material.

The intermediate pore size zeolite has a Constraint Index ranging from about 2 to 12, preferably about 8 to 10, more specifically about 8.3. The preferred intermediate pore size zeolite contemplated has the topology of ZSM-5 which is described in U.S. Pat. No. 3,702,886 and reference should be made thereto for a complete description of ZSM-5.

The large pore size zeolite has a Constraint Index of up to about 2, ranging from about 0.4 to 1, more specifically 0.6. Reference is here made to U.S. Pat. No. 4,784,745 for a definition of Constraint Index and a description of how this value is measured. The preferred large pore size zeolite contemplated has the topology of zeolite beta which is described in U.S. Pat. No. 3,308,069 and RE 28,341 to which reference should be made for a description of zeolite beta. These patents are herein incorporated by reference in their entireties.

Zeolite beta is a crystalline aluminosilicate having a pore size greater than about 5 Angstrom units. The composition of the zeolite in its as-synthesized form may be expressed as follows:

$$[XNa(1.0\pm0.1-X)TEA]AlO_2.YSiO_2.WH_2O$$

where X is less than 1, preferably less than 0.7; TEA represents the tetraethylammonium ion; Y is greater than 5 but less than 100; and W is up to about 60 (it has been found that the degree of hydration may be higher than originally determined where W was defined as being up to 4) depending on the degree of hydration and the metal cation present. The TEA component is calculated by differences from the analyzed value of sodium and the theoretical cation to structural aluminum ratio of unity.

The preferred forms of zeolite beta for use in the present process are the high silica forms, having silica-to-alumina mole ratios of at least 10:1, and preferably in the range of 20:1 to 50:1 in the as-synthesized form. It has been found that zeolite beta may be prepared and synthesized with silica-to-alumina mole ratios greater than 50:1, more specifically greater than 200:1, and even higher as described in U.S. patent application Ser. No. 715,190, filed on Jun. 14, 1991 and Ser. No. 715,270, filed on Jun. 14, 1991 the disclosures of which are incorporated by reference herein in their entireties. The silica-to-alumina mole ratio of the zeolite in its as-synthesized form may be increased by techniques such as steaming and other dealumination methods, and a certain measure of dealumination will take place during use under the influence of the hydrothermal conditions encountered during use.

The silica-to-alumina mole ratios referred to are the structural or framework ratios; that is, the ratio of the $SiO_2$ to the $AlO_4$ tetrahedra, which together constitute the structure of which the zeolite is composed. This ratio may vary from the silica-to-alumina ratio determined by various physical and chemical methods. For example, a gross chemical analysis may include aluminum which is present in the form of cations associated with the acidic sites on the zeolite, thereby giving a low silica-to-alumina ratio. Similarly, if the ratio is determined by the thermogravimetric analysis (TGA) of ammonia desorption, a low ammonia titration may be obtained if cationic aluminum prevents exchange of the ammonium ions onto the acidic sites. These disparities are particularly troublesome when certain treatments, such as the dealumination method described below which result in the presence of ionic aluminum free of the zeolite structure, are employed. Due care should therefore be taken to ensure that the framework silica-to-alumina ratio is correctly determined.

For silica-to-alumina mole ratios above the as-synthesized values described above, post-synthesis methods of treating the zeolite are usually necessary. One such method comprises dealumination by extraction with acid, particularly a mineral acid or an organic acid.

When it is used in the present catalysts, the zeolite is at least partly in the hydrogen form in order to provide the desired acidic functionality for the cracking reactions which are to take place. As stated above, the zeolite's acidic functionality can be characterized by the alpha value. The acidic functionality may be controlled by base exchange of the zeolite, especially with alkali metal cations, such as sodium, by steaming or by control of the silica-to-alumina mole ratio of the zeolite.

Zeolite beta in addition to possessing a composition as defined above may also be characterized by its X-ray diffraction data which are set forth in U.S. Pat. Nos. 3,308,069 and Re. 28,341.

When synthesized in the alkali metal form, zeolite beta may be converted to the hydrogen form, by formation of the intermediate ammonium form, as a result of ammonium ion-exchange and calcination of the ammonium form to yield the hydrogen form. In addition to the hydrogen form, other forms of the zeolite in which the original alkali metal content has been reduced may be used. Thus, the original alkali metal of the zeolite may be replaced by ion-exchange with the other suitable metal cations, including, by way of, for example, copper, zinc, calcium, rare earth metals, and preferably platinum.

As stated previously, another component used in the second step of this invention is a zeolite having the topology of ZSM-5. There are many ways of synthesizing ZSM-5 which have been described. The ZSM-5 zeolite used in the invention usually will have the original cations associated therewith replaced by a wide variety of other cations according to techniques well known in the art. Typical replacing cations would include hydrogen, ammonium and metal cations including mixtures of the same.

Typical ion exchange techniques would be to contact the zeolite with a salt of the desired replacing cation or cations. Although a wide variety of salts can be employed, particular preference is given to chlorides, nitrates and sulfates.

Prior to use, the zeolites should be dehydrated at least partially. This can be done by heating to a temperature in the range of 440° F. to 1100° F. in an air or an inert atmosphere, such as nitrogen for 1 to 48 hours. Dehydration can also be performed at lower temperatures by using a vacuum, but a longer time is required to obtain a sufficient amount of dehydration.

It is also possible to treat the zeolite with steam at elevated temperatures ranging from 800° F. to 1600° F. and treatment may be accomplished in atmospheres consisting partially or entirely of steam.

A preferred embodiment of the invention employs the use of a binder or substrate into which the zeolites are incorporated because the particle sizes of the pure zeolitic behaving materials are too small and lead to an excessive pressure drop in a catalyst bed. This binder or substrate, which is preferably used in this service, is suitably any refractory binder material. Examples of these materials are well known and typically include silica, silica-alumina, silica-zirconia, silica-titania, alumina.

The zeolite materials are exemplary of the topology and pore structure of suitable acid-acting refractory solids. A useful catalyst system is not confined, however, to the aluminosilicate versions and other refractory solid materials which are characterized by the above-described acid activity, pore structure and topology may be used. The zeolite designations referred to above, for example define the topology only and do not restrict the compositions of the zeolitic-behaving catalyst components.

Where one catalyst bed is employed, the zeolites can be present in about equal amounts in order to achieve a balance in the properties that each will contribute to the overall process. However, the relative proportion of the ZSM-5 component can be lower than the zeolite beta component. That is, based on the zeolite beta component, the ZSM-5 component can be used in lower amounts, for example, less than 50 wt percent, preferably from 5 wt. % to 30 wt. %, based on the amount of the zeolite beta. If a higher proportion of the more selective ZSM-5 component is preferred, then, based on the ZSM-5 component less than about 50 wt. % of the zeolite beta component, preferably ranging from 5 wt. % to 30 wt. %, based on the amount of the ZSM-5 component can be used.

Both zeolite components need not be mixed with the same matrix. Each can be incorporated into its own separate binder.

The preferred catalyst is HZSM-5/$Al_2O_3$ (65/35 wt %) and H-zeolite beta/$Al_2O_3$ (65/35 wt %).

The octane efficiency of the process; that is, the octane gain relative to the yield loss will vary according to a number of factors, including the nature of the feedstock, the conversion level and the relative proportions and activities of the catalysts.

As stated previously, one or both of the catalysts used in this step of the process may contain a metal hydrogenation function for improving catalyst aging or regenerability; on the other hand, depending on the feed characteristics, process configuration (cascade or two-step) and operating parameters, the presence of a metal hydrogenation function may be undesirable because it may tend to promote saturation of olefinics produced in the cracking reactions. If found to be desirable under the actual conditions used with particular feeds, metals such as the Group VIII base metals or combinations will normally be found suitable, for example nickel platinum or palladium. The metal component will vary depending upon the preferred performance. Preferably, this is incorporated with the zeolite beta component. The amount can range from 0.1 to 15 wt %, preferably 0.5 to 5 wt % based on the entire weight of the catalyst composite.

PRODUCT OPTIMIZATION

The conditions of operation and the catalyst proportion should be selected, together with appropriate feed characteristics to result in a product slate in which the gasoline product octane is not substantially lower than the octane of the feed gasoline boiling range material; that is not lower by more than about 1 to 3 octane numbers. It is preferred also that the volumetric yield of the product is not substantially diminished relative to the feed. In some cases, the volumetric yield and/or octane of the gasoline boiling range product may well be higher than those of the feed, as noted above and in favorable cases, the octane barrels (that is the octane number of the product times the volume of product) of the product will be higher than the octane barrels of the feed.

The operating conditions in the first and second steps may be the same or different but the exotherm from the hydrotreatment step will normally result in a higher initial temperature for the second step. Where there are distinct hydrodesulfurization and hydrocracking conversion zones, whether in cascade operation or otherwise, it is often desirable to operate the two zones under different conditions. Thus the hydrocracking zone may be operated at higher temperature and lower pressure than the hydrodesulfurization zone in order to maximize the octane increase obtained in this zone.

Further increases in the volumetric yield of the gasoline boiling range fraction of the product, and possibly also of the octane number (particularly the motor octane number), may be obtained by using the $C_3$–$C_4$ portion of the product as feed for an alkylation process to produce alkylate of high octane number. The light ends from the second step of the process are particularly suitable for this purpose since they are more olefinic than the comparable but saturated fraction from the hydrotreating step. Alternatively, the olefinic light ends from the second step may be used as feed to an etherification process to produce ethers such as MTBE or TAME for use as oxygenate fuel components. Depending on the composition of the light ends, especially the paraffin/olefin ratio, alkylation may be carried out with additional alkylation feed, suitably with isobutane which has been made in this or a catalytic cracking process or which is imported from other operations, to convert at least some and preferably a substantial proportion, to high octane alkylate in the gasoline boiling range, to increase both the octane and the volumetric yield of the total gasoline product.

In the operation of this process, it is reasonable to expect that, with a heavy cracked naphtha feed, the first step hydrodesulfurization will reduce the octane number by at least 1.5%, more normally at least about 3%. With a full range naphtha feed, it is reasonable to expect that the hydrodesulfurization operation will reduce the octane number of the gasoline boiling range fraction of the first intermediate product by at least about 5%, and, if the sulfur content is high in the feed, that this octane reduction could go as high as about 15%.

The second step of the process should be operated under a combination of conditions such that at least about half (½) of the octane lost in the first step operation will be recovered, preferably such that all of the lost octane will be recovered, most preferably that the second step will be operated such that there is a net gain of at least about 1% in octane over that of the feed, which is about equivalent to a gain of about at least about 5% based on the octane of the hydrotreated intermediate.

The process should normally be operated under a combination of conditions such that the desulfurization should be at least about 50%, preferably at least about 75%, as compared to the sulfur content of the feed.

What is claimed is:

1. A process of upgrading a catalytically cracked sulfur-containing catalytically cracked feed fraction boiling in the gasoline boiling range having a 95% point of at least about 325° F. which comprises:

contacting the catalytically cracked sulfur-containing feed fraction with a hydrodesulfurization catalyst in a first reaction step, operating under a combination of elevated temperature, elevated pressure and an atmosphere comprising hydrogen, to produce an intermediate product comprising a normally liquid fraction which has a reduced sulfur content and a reduced octane number as compared to the feed; and contacting at least the gasoline boiling range portion of the intermediate product in a second reaction step over a first catalyst zone comprising a large pore zeolite material and a second catalyst zone comprising an intermediate pore size zeolite material in the presence of hydrogen to effect long chain paraffin isomerization and back end conversion reactions in the first catalyst zone followed by selective cracking of the converted products in the second catalyst zone to convert it to a product comprising a fraction boiling in the gasoline boiling range having a higher octane number than the gasoline boiling range fraction of the intermediate product.

2. The process as claimed in claim 1 in which the gasoline boiling range portion of the intermediate product is passed over the first catalyst zone before the second catalyst zone.

3. The process as claimed in claim 2 in which the zeolite of the first catalyst zone is a zeolite having the topology of zeolite beta.

4. The process as claimed in claim 2 in which the zeolite of the second catalyst zone is a zeolite having the topology of ZSM-5.

5. The process as claimed in claim 1 in which said feed fraction comprises a light naphtha fraction having a boiling range within the range of $C_6$ to 330° F.

6. The process as claimed in claim 1 in which said feed fraction comprises a full range naphtha fraction having a boiling range within the range of $C_5$ to 420° F.

7. The process as claimed in claim 1 in which said feed fraction comprises a heavy naphtha fraction having a boiling range within the range of 330° to 500° F.

8. The process as claimed in claim 1 in which said feed fraction comprises a heavy naphtha fraction having a boiling range within the range of 330° to 412° F.

9. The process as claimed in claim 1 in which said feed fraction comprises a naphtha fraction having a 95 percent point of at least about 350° F.

10. The process as claimed in claim 9 in which said feed fraction comprises a naphtha fraction having a 95 percent point of at least about 380° F.

11. The process as claimed in claim 10 in which said feed fraction comprises a naphtha fraction having a 95 percent point of at least about 400° F.

12. The process as claimed in claim 1 in which the zeolites are in the aluminosilicate form.

13. The process as claimed in claim 1 in which the hydrodesulfurization catalyst comprises a Group VIII and a Group VI metal.

14. The process as claimed in claim 1 which is carried out in two stages with an interstage separation of light ends and heavy ends with the heavy ends fed to the first reaction step.

15. The process as claimed in claim 1 in which the normally liquid intermediate product from the first reaction step comprises a $C_8+$ fraction having an initial point of at least 210° F.

16. A process of upgrading a sulfur-containing feed fraction boiling in the gasoline boiling range which comprises:

hydrodesulfurizing a catalytically cracked, olefinic, sulfur-containing gasoline feed having a sulfur content of at least 50 ppmw, an olefin content of at least 5 percent and a 95 percent point of at least 325° F. with a hydrodesulfurization catalyst in a hydrodesulfurization zone, operating under a combination of elevated temperature, elevated pressure and an atmosphere comprising hydrogen, to produce an intermediate product comprising a normally liquid fraction which has a reduced sulfur content and a reduced octane number as compared to the feed; and contacting at least the gasoline boiling range portion of the intermediate product in an octane restoring reaction zone over a first catalyst zone comprising a catalyst comprising a large pore size zeolite material and a second catalyst zone comprising a catalyst comprising an intermediate pore size zeolite material in the presence of hydrogen to effect isomerization of heavy paraffins and back end conversion reactions in the first catalyst zone followed by selective cracking of the converted products in the second catalyst zone to convert it to a product comprising a fraction boiling in the gasoline boiling range having a higher octane number than the gasoline boiling range fraction of the intermediate product.

17. The process as claimed in claim 16 in which the gasoline boiling range portion of the intermediate product is passed over the first catalyst zone before the second catalyst zone.

18. The process as claimed in claim 17 in which the zeolite of the first catalyst zone is a zeolite having the topology of zeolite beta.

19. The process as claimed in claim 17 in which the zeolite of the second catalyst zone is a zeolite having the topology of ZSM-5.

20. The process as claimed in claim 16 in which said feed fraction comprises a naphtha fraction having a 95 percent point of at least about 380° F.

21. The process as claimed in claim 16 in which the zeolite materials are in the aluminosilicate form.

22. The process as claimed in claim 16 which is carried out in two stages with an interstage separation of light ends and heavy ends with the heavy ends fed to the octane restoration zone.

23. The process as claimed in claim 16 which is carried out in cascade mode with the entire effluent from the hydrodesulfurization is passed to the octane restoration zone.

* * * * *